US007033003B2

(12) United States Patent
Martin et al.

(10) Patent No.: US 7,033,003 B2
(45) Date of Patent: Apr. 25, 2006

(54) CONTINUOUS STREAM BINARY ARRAY INK JET PRINT HEAD

(75) Inventors: Graham Dagnall Martin, Sawston (GB); Nigel Edward Sherman, St. Edmunds (GB); Sukbir Singh Pannu, Grantchester (GB)

(73) Assignee: Videojet Technologies Inc., Wood Dale, IL (US)

( * ) Notice: Subject to any disclaimer, the term of this patent is extended or adjusted under 35 U.S.C. 154(b) by 0 days.

(21) Appl. No.: 10/276,528

(22) PCT Filed: May 14, 2001

(86) PCT No.: PCT/GB01/02113

§ 371 (c)(1),
(2), (4) Date: Apr. 14, 2003

(87) PCT Pub. No.: WO01/87616

PCT Pub. Date: Nov. 22, 2001

(65) Prior Publication Data

US 2003/0156169 A1 Aug. 21, 2003

(51) Int. Cl.
*B41J 2/02* (2006.01)

(52) U.S. Cl. ..... 347/75

(58) Field of Classification Search ..... 347/73–77, 347/68–70; 29/890.1
See application file for complete search history.

(56) References Cited

U.S. PATENT DOCUMENTS 3,984,843 A * 10/1976 Kuhn ..... 347/76
4,095,232 A * 6/1978 Cha ..... 347/75
4,370,663 A 1/1983 Markham ..... 347/75
4,651,163 A * 3/1987 Sutera et al. ..... 347/76
6,484,400 B1 * 11/2002 Motegi et al. ..... 29/890.1

FOREIGN PATENT DOCUMENTS

| | | |
|---|---|---|
| EP | 0 020 182 A1 | 12/1980 |
| EP | 0 911 167 A2 | 4/1999 |
| GB | 1 354 890 | 5/1974 |
| GB | 1 432 366 | 4/1976 |
| GB | 1 464 370 | 2/1977 |

* cited by examiner

*Primary Examiner*—K. Feggins
(74) *Attorney, Agent, or Firm*—Kirschstein, et al.

(57) ABSTRACT

A continuous stream binary array ink jet print head includes an elongate cavity for containing ink and an array of nozzle orifices formed so as to extend through a wall of the cavity for passing the ink from the cavity to form jets. The nozzle orifices extend along the length of the cavity. The cavity is divided up along its length by at least one internal wall thereby to create a plurality of sub-cavities substantially acoustically isolated from one another and to divide up the array of nozzle orifices between the sub-cavities such that each sub-cavity communicates with one or more of the nozzle orifices of the array. One or more actuators associated with each sub-cavity cyclically varies the dimensions of the sub-cavity thereby to cause the or each jet emanating from the nozzle orifice(s) of that sub-cavity to break up into ink droplets at a predetermined distance therefrom. The droplets of each jet are selectively electrically charged and deflected. A gutter is provided for collecting droplets not used in printing. The droplets of each jet used in printing travel along the same path to print.

10 Claims, 4 Drawing Sheets

CONTINUOUS STREAM BINARY ARRAY INK JET PRINT HEAD

This invention relates to a continuous stream binary array ink jet print head.

More particularly the invention relates to such a print head comprising: an elongate cavity for containing the ink; an array of nozzle orifices formed so as to extend through a wall of said cavity for passing ink from the cavity to form jets, said nozzle orifices extending along the length of said cavity; actuator means for cyclically varying the dimensions of the cavity thereby to cause each jet emanating from said nozzle orifices to break up into ink droplets at a predetermined distance therefrom; charging means for selectively electrically charging the droplets of each jet; deflecting means for deflecting the charged droplets; and a gutter for collecting droplets not used in printing, the droplets of each jet used in printing travelling along the same path to print.

In continuous stream binary array ink jet printers, an ink cavity is pressurized and continuous jets of ink arc formed by ink flowing, under pressure, through an array of nozzle orifices communicating with the cavity. One, or a small number of, piezoelectric actuators provide an acoustic disturbance to the ink cavity or provide a regular disturbance to the structure containing the orifice array. This disturbance is transmitted to the jets, which break up into droplets at the frequency of the disturbance. If the structure is properly designed then an approximately uniform disturbance is produced across the array of jets, leading to a uniform drop break off time across the array.

It is important that all the jets are substantially equally stimulated so that droplets are produced at approximately the same distance from the nozzle orifices for all the jets. The problem lies in producing a combination of transducer, cavity and structure that produces a uniform acoustic disturbance along the array. This is difficult because unwanted vibrations in the cavity, structure, or transducer can interfere with the uniform disturbance. In addition, changes in parameters such as temperature and ink composition can change the wavelength of sound in the ink and/or the structure, thereby altering the acoustic conditions within the cavity or structure away from those for which the print head has been designed. Further, as the length of the array increases, it becomes more difficult to set up a uniform disturbance as more vibrational modes in the 'along-the-array' direction can interfere with the intended disturbance.

According to the present invention there is provided a continuous stream binary array ink jet print head comprising: an elongate cavity for containing the ink; an array of nozzle orifices formed so as to extend through a wall of said cavity for passing ink from the cavity to form jets, said nozzle orifices extending along the length of said cavity, said cavity being divided up along its length by at least one internal wall thereby to create a plurality of sub-cavities substantially acoustically isolated from one another, said dividing up of the cavity to form sub-cavities correspondingly dividing up said array of nozzle orifices between the sub-cavities such that each sub-cavity communicates with one or more of the nozzle orifices of the array, one or more actuator means associated with each said sub-cavity for cyclically varying the dimensions of the sub-cavity thereby to cause the or each jet emanating from the nozzle orifice(s) of that sub-cavity to break up into ink droplets at a predetermined distance therefrom; charging means for selectively electrically charging the droplets of each jet; deflecting means for deflecting the charged droplets; and a gutter for collecting droplets not used in printing, the droplets of each jet used in printing travelling along the same path to print, each said sub-cavity being dimensioned so as to be non-resonant in operation.

Various refinements to the present invention in terms of the number of nozzle orifices and actuator means per sub-cavity, are contemplated. These are as follows: one actuator means per sub-cavity; one actuator means and one nozzle orifice per sub-cavity; two or more actuator means per sub-cavity; one actuator means and two or more nozzle orifices per sub-cavity; two or more actuator means and two or more nozzle orifices per sub-cavity; one actuator means and three or more nozzle orifices per sub-cavity; and two or more actuator means and three or more nozzle orifices per sub-cavity.

By dividing up the ink cavity into a plurality of sub-cavities, a plurality of local acoustic environments is created, each in respect of a relatively small number of nozzle orifices. This enables the individual acoustic tailoring of each environment to best suit the small number of orifices it concerns, without the requirement to consider effects on the other orifices of the array. It is to be noted that the nozzle orifice spacing necessary to achieve binary array printing is maintained.

Ink jet print heads, which have a transducer for ink ejection associated with one or a few nozzle orifices, are used in drop on demand ink jet printing. In this case no pressurization is used. Commonly either a thermal or piezoelectric transducer is used to supply an impulsive energy to a drop of ink which moves it from rest within the nozzle orifice to some velocity, projecting it onto the substrate. Such devices are limited in operational speed by their unpressurised nature. An example of a thermally driven drop on demand printer is described in U.S. Pat. No. 4,723,129. An example of a piezoelectricity actuated drop on demand system is described in U.S. Pat. No. 3,683,212.

An advantage of the present invention over drop on demand techniques is that the energy required to create droplets by disturbing continuous jets is significantly lower than that required to eject a complete drop. Thus, the actuator means of the present invention are easier to design and manufacture because the area required thereof is smaller. The foregoing provides higher resolutions and drop generation frequencies, and affords more compact design.

U.S. Pat. No. 4,638,328 describes a continuous stream array ink jet printer in which channels are constructed by bringing together two surfaces, one with grooves and one with thermal actuators, to define an array of separately actuated channels and nozzle orifices. Applying current pulses to the thermal actuators in each of the channels perturbs the continuous jets emerging from this structure. This structure has a number of problems. Using the method described it is very difficult to fabricate nozzle orifices which are uniform enough to allow continuous jet printing. Also much 'waste' heat is generated which must be removed from the area of the channels so that the device will operate correctly.

Single jet continuous systems produce a pressurized jet from a single orifice and operate by deflecting droplets in a direction perpendicular to the direction of movement of the surface receiving the image (substrate). In this way droplets from a single jet can address a number of pixel positions across the substrate. This is different from binary array systems where each jet addresses only one pixel location across the substrate and the droplet deflection is in the direction parallel to the direction of substrate motion. There have been systems in which more than one single jet continuous system have been used together to print, for example, several lines of text. To achieve this there have been arrangements in which separate print heads have been positioned close to one another, and there have been systems where the print heads have been consolidated so that they are fabricated side by side in the same manifold. In comparison with binary array systems, these systems are limited in speed and are difficult to control such that contiguous printing can take place between adjacent jets.

The invention will now be described, by way of example, with reference to the accompanying drawings, in which.

Figure 1:
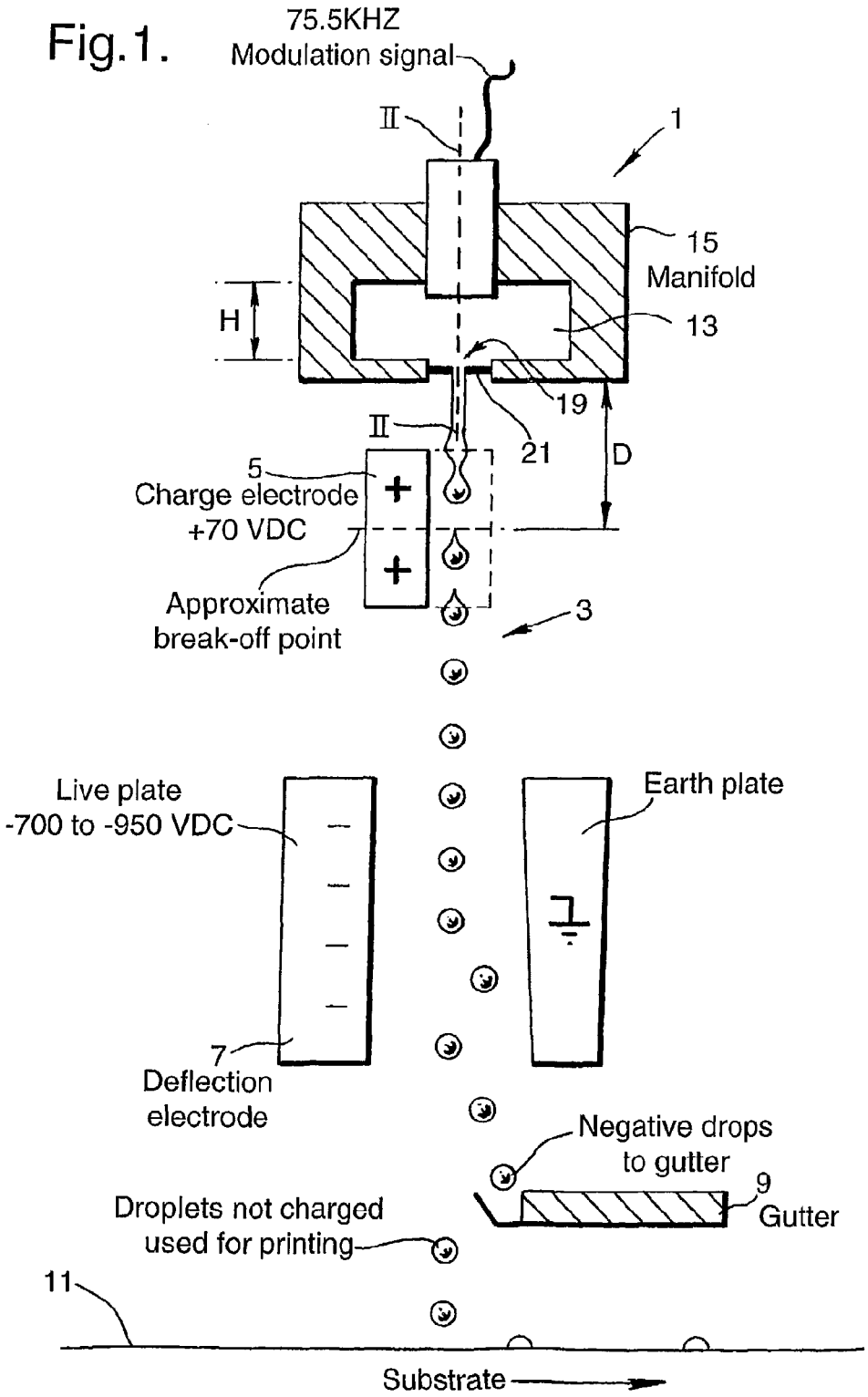
FIG. 1 is a schematic representation of a prior art continuous stream binary array ink jet print head.
Figure 2:
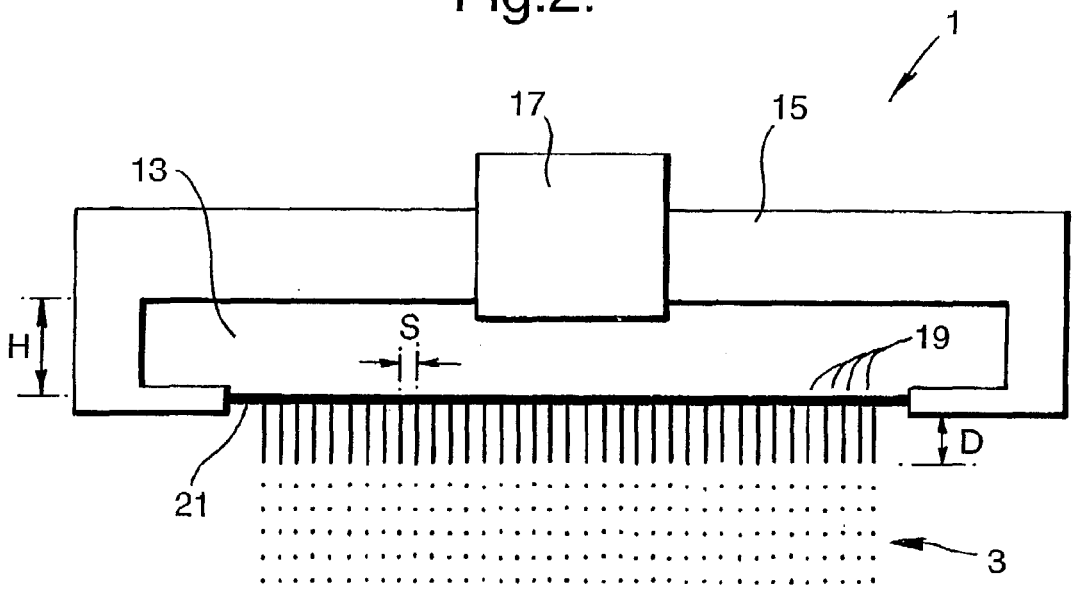
FIG. 2 is a cross-section on the line II—II in FIG. 1.

Referring to FIGS. 1 and 2, the prior art print head comprises: a droplet generator 1 for generating a linear array 3 of streams of ink droplets; charge electrodes 5, one for each stream, for selectively either charging or not the ink droplets; a single deflection electrode 7 for all streams to deflect charged droplets; and a gutter 9 for collecting charged droplets, uncharged droplets printing on substrate 11 moving in a direction perpendicular to the plane of the array 3 of droplet streams. Droplet generator 1 comprises an ink cavity 13 defined by a surrounding manifold 15, and a transducer 17 centrally located above cavity 13 for addressing the ink therein. A line of nozzle orifices 19, each formed so as to extend through a wall 21 of cavity 13, runs along the length of cavity 13.

Ink is supplied to cavity 13 under pressure, and emanates from nozzle orifices 19 to create the linear array of ink jet streams. Vibration of the ink in cavity 13 by means of transducer 17 causes each ink jet stream to break up into droplets at the same distance D from wall 21, approximately midway past a charge electrode 5, as shown in FIG. 1. As is known in the art, each droplet, as it is formed within a charge electrode 5, is either charged or not depending upon whether it is desired to print or not that droplet.

An image is built up on substrate 11 from a two-dimensional matrix of positions at which it is possible to deposit ink droplets on the substrate. The particular image to be created determines the selective charging of the droplets and thereby the positions at which droplets are actually deposited. The frequency of possible droplet print positions in the direction parallel to the plane of linear array 3 is determined by the spacing S between nozzle orifices 19. The frequency of droplet print positions in the direction perpendicular to this plane is determined by the speed of movement of the substrate and the frequency of generation of droplets.

Cavity 13 is dimensioned so as to be resonant in its height H at operating frequency, i.e. at the frequency of excitation of transducer 17. More particularly, at operating frequency, one standing wave half-wavelength precisely fits within the vertical dimension of cavity 13 such that an acoustic pressure antinode is present at both the bottom and top faces of cavity 13 and an acoustic pressure node is present half-way up cavity 13. This arrangement provides both efficient energy transference to the ink in cavity 13 and equal stimulation of all the jets so that each breaks up at the same distance from wall 21.

There are a number of problems encountered with the prior art print head of FIGS. 1 and 2.

It is difficult to achieve the required substantially equal stimulation of all jets along the array since the acoustic environment presented to the jets varies along the array. For example, the acoustic environment presented to jets centrally located within the array is a transducer directly above and relatively nearby, and cavity end walls equally distant to either side and relatively far away. In contrast, the acoustic environment presented to jets located at the extremes of the array is a transducer to one side and relatively far away, and cavity end walls to either side but one nearby and the other far away. Indeed, the standing wave at resonance, established in operation of the prior art print head, is a special case, wherein, despite the acoustic environment varying along the array, substantially equal stimulation of all jets is achieved. In other words, the variation in acoustic environment in the prior art print head dictates that operation must be at the aforesaid resonance only otherwise uniform jet stimulation is not achieved.

Further, since the design is so that cavity 13 operate at resonance, droplet generator 1 is very sensitive to stray in operating parameters such as temperature and ink composition. If temperature or ink composition stray from the required values, the speed of sound in the ink changes causing a corresponding change in the wavelength of sound in the ink. This results in the standing wave half-wavelength no longer precisely fitting in the vertical dimension of cavity 13.

Also, a single cavity elongate in form is prone to the establishment of unwanted vibration along the length of the cavity.

Figure 3:
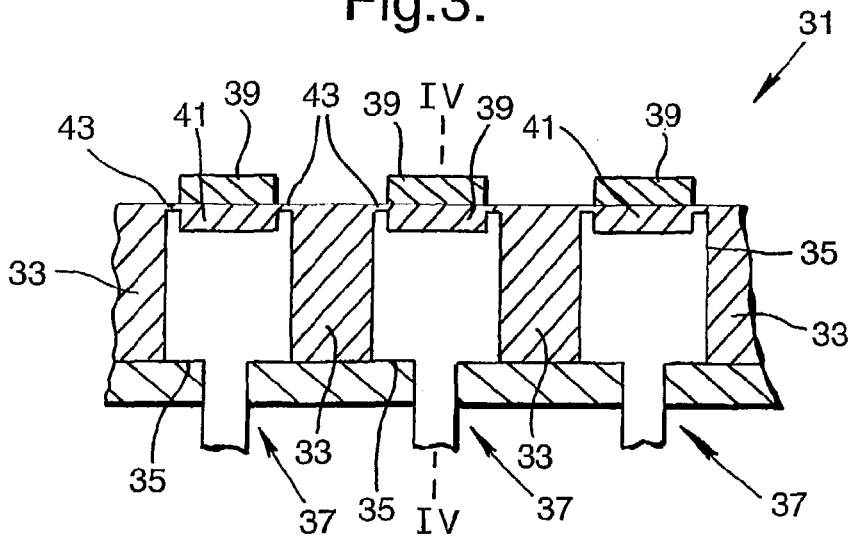
FIG. 3 is a schematic illustration of a central part of a first droplet generator to replace the droplet generator of the prior art print head of FIGS. 1 and 2, such replacement resulting in a first continuous stream binary array ink jet print head in accordance with the present invention.
Figure 4:
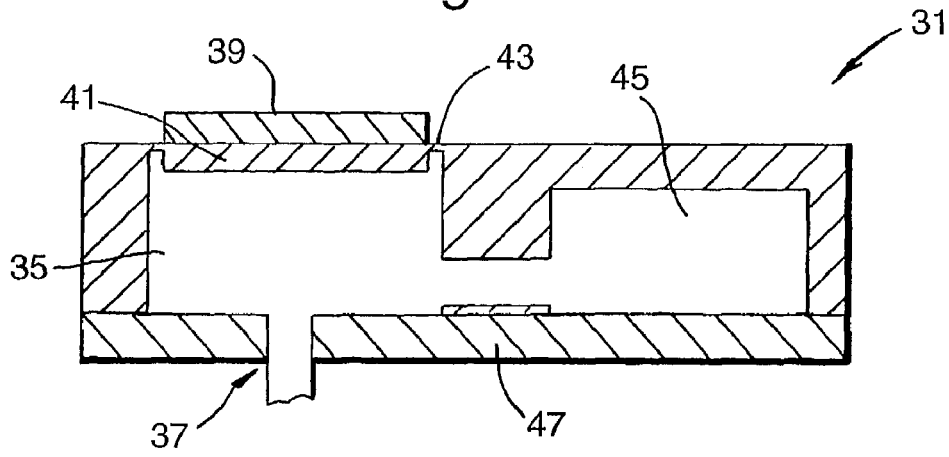
FIG. 4 is a cross-section on the line IV—IV in FIG. 3.
Figure 5:
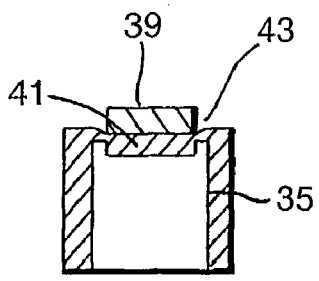
FIG. 5 illustrates operation of the droplet generator of FIGS. 3 and 4.

Reference will now also be made to FIGS. 3 to 5. It is to be noted that in FIG. 3 a central part only of the first replacement droplet generator 31 is shown, since, to each side, generator 31 is merely a repeat of the central part shown.

In generator 31, a main ink cavity is divided up along its length by internal walls 33 to create an array of sub-cavities 35 acoustically isolated from one another. The dividing up is such that there is one sub-cavity in respect of each nozzle orifice 37. The spacing between nozzle orifices 37 is the same as in droplet generator 1 of FIGS. 1 and 2. The height of each sub-cavity 35, typically 100 ?m, is much reduced as compared to the height of cavity 13 of generator 1 of FIGS. 1 and 2, which height is typically 3–5 mm high. A piezoelectric element 39 is secured to the top wall 41 of each sub-cavity 35 for vibrating the ink therein. In each top wall 41, thin regions 43 are made around the piezoelectric element. Thus, regions 43 have a low stiffness, so that when a stimulation frequency is applied to piezoelectric element 39 the mass formed by element 39 and wall 41 oscillates on the spring formed by thin regions 43. This is shown in FIG. 5. Each sub-cavity 35 communicates with a common ink supply 45 via a respective ink feed channel 47, see FIG. 4. Ink is supplied to common ink supply 45 under pressure Since each nozzle orifice 37 has its own local acoustic environment, any correction required to the jet break up length of an orifice can be made by adjustment or trimming of the local acoustic environment associated with that orifice. Suitably, a common electrical drive is provided to all piezoelectric elements 39, and an impedance of an appropriate value incorporated in the drive to any orifice requiring correction.

The ink in each sub-cavity 35 is vibrated by vibrating the sub-cavity wall opposite the sub-cavity orifice. Since each orifice has its own acoustic environment, this need not be the case. For example, each sub-cavity wall opposite common ink supply 45 (FIG. 4) could be vibrated. For the same reason, not all of the top wall of each sub-cavity need be vibrated. However, it is necessary that sufficient vibrational energy be communicated to the ink. In this connection, it is possible to extend the dimension of each sub-cavity in the direction perpendicular to the plane of the linear array of ink jets (FIG. 4) as this dimension is not constrained by orifice spacing.

Each piezoelectric element 39 is driven at approximately the same frequency as single transducer 17 of the prior art print head. The sub-cavities 35 are not resonant at this frequency, since the dimensions of each sub-cavity are much smaller than half the wavelength of sound in the ink. Operation at resonance is not required of each sub-cavity 35, since there is no variation in orifice acoustic environment within a sub-cavity, there being only one orifice per sub-cavity. The removal of the requirement to operate at resonance provides a droplet generator which is very tolerant of stray in operating parameters such as temperature and ink composition.

Figure 7:
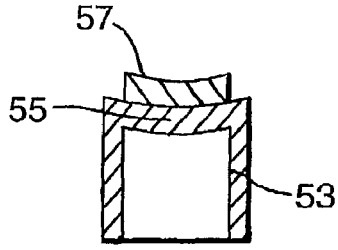
FIG. 7 illustrates operation of the droplet generator of FIG. 6.
Figure 6:
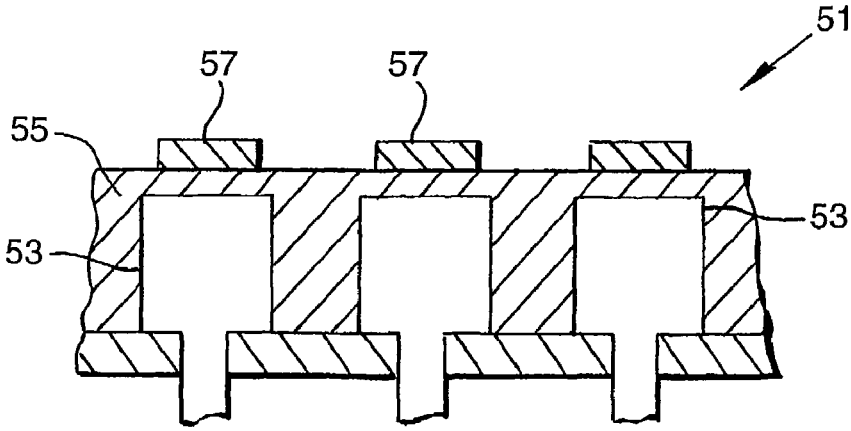
FIG. 6 is a schematic illustration of a central part of a second droplet generator to replace the droplet generator of the prior art print head of FIGS. 1 and 2, such replacement resulting in a second continuous stream binary array ink jet print head in accordance with the present invention.

Referring now also to FIGS. 6 and 7, the second replacement droplet generator 51 is the same as the first apart from the means by which vibration is achieved in each sub-cavity 53. In generator 51 there are not thin regions in the top wall 55 of each sub-cavity 53. The piezoelectric element 57 secured to the top wall of each sub-cavity forms a unimorph therewith. Thus, when an alternating voltage is applied to a piezoelectric element 57, it cyclically changes shape, cyclically distorting the top wall or ceiling of the associated sub-cavity, vibrating the ink. This is shown in FIG. 7.

Although in each of the first and second replacement droplet generators of FIGS. 3 to 7, a main ink cavity is divided up so that each sub-cavity feeds only one nozzle orifice, the division could be such that each feeds two or more orifices.

Figure 8:
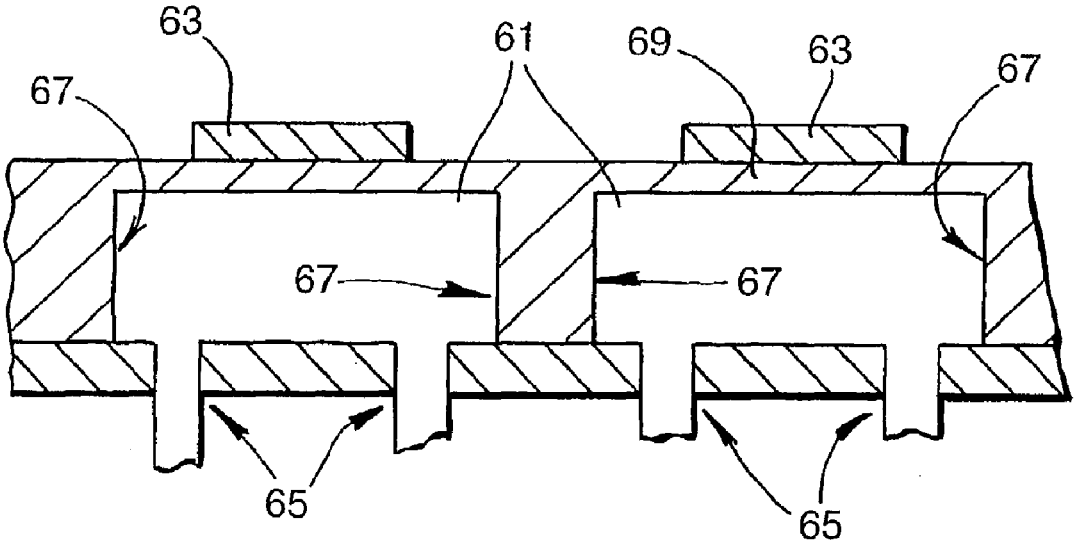
FIG. 8 illustrates a modification to the second replacement droplet generator of FIGS. 6 and 7.

With reference to FIG. 8, there will now be considered a modification to the second replacement droplet generator of FIGS. 6 and 7, in which modification a main ink cavity is divided up so as to create sub-cavities each of which feeds two orifices. The same modification could equally be made to the first replacement droplet generator of FIGS. 3 to 5. The modification, in effect, comprises the removal of the every other internal dividing wall along the length of the droplet generator, and the replacement of the two piezoelectric elements above each thereby created larger sub-cavity 61 by a single larger piezoelectric element 63. Thus, the spacing between nozzle orifices 65 remains as it was in the first and second replacement droplet generators and the prior art print head.

Although each of the two nozzle orifices 65 of each larger sub-cavity 61 will see surrounding environments which are mirror images of one another, in terms of acoustics, these environments are the same. In each sub-cavity 61, there is one sub-cavity end wall 67 nearby each orifice 65 and one further away, and the sub-cavity transducer (formed by piezoelectric element 63 and top wall 69) is equidistant from both orifices. Thus, each larger sub-cavity 61 does not suffer from the problem encountered in the prior art that the acoustic environment varies from one orifice to the next.

In the case where main ink cavity division is such that each sub-cavity feeds three or more nozzle orifices, there will be some variation in acoustic environment within a sub-cavity. However, this variation is to be compared to the much greater variation which takes place along the full length of the undivided main cavity. Thus, even minimal main cavity division facilitates finer control of jet break up length along the full length of the array.

Figure 9:
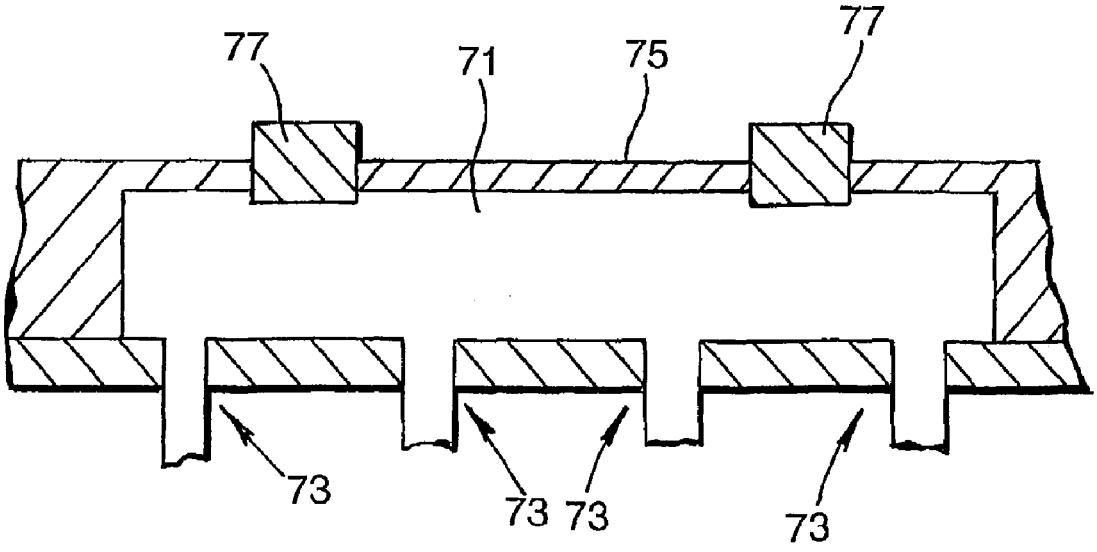
FIG. 9 illustrates schematically a central part of a third droplet generator to replace the droplet generator of the prior art print head of FIGS. 1 and 2, such replacement resulting in a third continuous stream binary array ink jet print head in accordance with the present invention.

Although in the above description a single transducer is provided in respect of each sub-cavity, it is to be appreciated that more than one may be used. In the third replacement droplet generator of FIG. 9, each sub-cavity 71 feeds four nozzle orifices 73. Resiliently mounted in the top wall 75 of each sub-cavity 71 are two transducers 77 (piezoelectrically driven) each disposed directly above two adjacent orifices 73. Thus, in each sub-cavity 71, each transducer 77 is more local to the two orifices 73 it is directly above than the other two orifices of the sub-cavity. Each transducer in each sub-cavity therefore primarily addresses the two orifices it is directly above rather than the other two. This constitutes, in effect, a 'partial' division of each sub-cavity, and facilitates finer control of jet break up length than if there was only one centrally mounted transducer 77 in respect of each sub-cavity 71.

In the above description the sub-cavity creating internal walls extend all the way from the wall containing the nozzle orifices (the bottom wall) to the wall opposite containing the transducers (the top wall). This need not be the case. Provided sufficient acoustic isolation between sub-cavities is maintained, the internal walls could stop short of the top and bottom walls.

The invention claimed is:

1. A continuous stream binary array ink jet print head, comprising:

a) an elongate cavity for containing ink;

b) an array of nozzle orifices extending through a wall of the cavity for passing the ink from the cavity to form jets, said nozzle orifices extending along a length of the cavity, said cavity being divided up along its length by at least one internal wall thereby to create a plurality of sub-cavities substantially acoustically isolated from one another, and to divide up the array of nozzle orifices between the sub-cavities such that each sub-cavity communicates with at least one of the nozzle orifices of the array;

c) at least one actuator means associated with each said sub-cavity for cyclically varying dimensions of the sub-cavity thereby to cause at least one jet emanating from said at least one nozzle orifice of that sub-cavity to break up into ink droplets at a predetermined distance therefrom;

d) charging means for selectively electrically charging the droplets of said at least one jet;

e) deflecting means for deflecting the charged droplets; and f) a gutter for collecting droplets not used in printing, the droplets of said at least one jet used in printing traveling along a same path to print;

g) each said sub-cavity being dimensioned so as to be non-resonant in operation.

2. The print head according to claim 1, wherein one actuator means is associated with each sub-cavity.

3. The print head according to claim 2, wherein each sub-cavity communicates with one nozzle orifice.

4. The print head according to claim 2, wherein each sub-cavity communicates with a plurality of nozzle orifices.

5. The print head according to claim 2, wherein each sub-cavity communicates with at least three nozzle orifices.

6. The print head according to claim 1, wherein a plurality of actuator means is associated with each sub-cavity.

7. The print head according to claim 1, wherein said at least one actuator means comprises a combination of a sub-cavity wall together with a piezoelectric element secured thereto, the wall including regions of reduced stiffness around the piezoelectric element so as to facilitate spring-like oscillation of the wall and element within said regions.

8. The print head according to claim 1, wherein said at least one actuator means comprises a combination of a sub-cavity wall together with a piezoelectric element secured thereto, and wherein the piezoelectric element is operative for distorting the sub-cavity wall and vibrating the ink in the sub-cavity by changing in dimension.

9. The print head according to claim 1, wherein said at least one actuator means comprises a piezoelectrically driven transducer resiliently mounted in a sub-cavity wall.

10. The print head according to claim 1, wherein a common drive is provided to said at least one actuator means of the sub-cavities, and wherein the drive is provided to a number of the actuator means including an adjustment means for correcting jet break up length.

* * * * *